US011274553B2

(12) United States Patent
Xu et al.

(10) Patent No.: US 11,274,553 B2
(45) Date of Patent: Mar. 15, 2022

(54) PNEUMATIC ENGINE

(71) Applicant: TRANF TECHNOLOGY (XIAMEN) CO., LTD., Xiamen (CN)

(72) Inventors: Shuidian Xu, Xiamen (CN); Yanfu Li, Xiamen (CN); Jinghua Zeng, Xiamen (CN); Zhimin Chen, Xiamen (CN); Kaixin Jin, Xiamen (CN); Tao Xu, Xiamen (CN); Jianchen Pan, Xiamen (CN); Jianming Chen, Xiamen (CN)

(73) Assignee: TRANF TECHNOLOGY (XIAMEN) CO., LTD., Xiamen (CN)

( * ) Notice: Subject to any disclaimer, the term of this patent is extended or adjusted under 35 U.S.C. 154(b) by 199 days.

(21) Appl. No.: 16/687,625

(22) Filed: Nov. 18, 2019

(65) Prior Publication Data

US 2020/0088035 A1 Mar. 19, 2020

Related U.S. Application Data

(63) Continuation of application No. PCT/CN2018/088142, filed on May 24, 2018.

(30) Foreign Application Priority Data

Jun. 16, 2017 (CN) ..... 201710458557.3

(51) Int. Cl.
*F01D 1/02* (2006.01)
*F01D 1/34* (2006.01)

(52) U.S. Cl.
CPC ..... *F01D 1/02* (2013.01); *F01D 1/34* (2013.01)

(58) Field of Classification Search
CPC . F01D 1/02; F01D 1/023; F01D 1/026; F01D 1/22; F01D 1/32; F01D 1/34; F01D 1/36; F01D 1/38; F01D 5/03; F03B 1/00
See application file for complete search history.

(56) References Cited

U.S. PATENT DOCUMENTS 768,884 A * 8/1904 O'Brien ..... F01D 1/32 415/80
1,216,162 A 2/1917 Pratt
(Continued)

FOREIGN PATENT DOCUMENTS

CN 102296990 A 12/2011
CN 203570431 U 4/2014
(Continued)

OTHER PUBLICATIONS

The first Office Action of parallel JP application No. 2020-519168.
(Continued)

*Primary Examiner* — Christopher R Legendre
(74) *Attorney, Agent, or Firm* — J.C. Patents

(57) ABSTRACT

A pneumatic engine, comprising: a rotating outer ring (1), an intermediate shaft (2), a direct drive power core (3), and left and right baffles (4) and (5) where the rotating outer ring (1), the direct drive power core (3), and the left and right baffles (4) and (5) are coaxially provided on the intermediate shaft (2), the rotating outer ring (1) is integrally connected to the left and right baffles (4) and (5) to engage with the intermediate shaft (2) via a bearing, and a closed space is formed, the intermediate shaft (2) is provided with a master air inlet (21) and a master air outlet (22), the direct drive power core (3) is provided with a logarithmic spiral line runner, multiple drive grooves (11) are provided on an inner ring surface of the rotating outer ring (1). The pneumatic engine has a simple structure, high transmission efficiency and strong endurance.

5 Claims, 5 Drawing Sheets

(56) References Cited

U.S. PATENT DOCUMENTS

| | | | | | |
|---|---|---|---|---|---|
| 1,250,663 | A * | 12/1917 | Rohmer | F01D 1/32 415/80 |
| 1,355,090 | A * | 10/1920 | Collins | F01D 1/026 415/63 |
| 3,026,088 | A | 3/1962 | Green | |
| 2010/0237437 | A1 | 9/2010 | Takagi | |
| 2010/0239437 | A1 | 9/2010 | Maier | |
| 2011/0048003 | A1 | 3/2011 | Chen | |
| 2020/0088035 | A1* | 3/2020 | Xu | F01B 17/02 |
| 2021/0115810 | A1* | 4/2021 | Xu | F01D 1/32 |

FOREIGN PATENT DOCUMENTS

| | | | | |
|---|---|---|---|---|
| CN | 105019948 | A | 11/2015 | |
| CN | 106321151 | A | 1/2017 | |
| CN | 107083994 | A | 8/2017 | |
| CN | 206742813 | U | 12/2017 | |
| CN | 206942813 | U | 1/2018 | |
| GB | 252424 | A * | 5/1926 | F03B 1/00 |
| JP | A1977041747 | | 3/1977 | |
| JP | A1998047002 | | 2/1998 | |
| JP | 2005188378 | A * | 7/2005 | |
| JP | 2005188378 | A | 7/2005 | |
| JP | 2014513243 | A | 5/2014 | |
| RU | 148081 | U1 | 11/2014 | |
| UA | 91458 | C2 | 7/2010 | |
| WO | WO-0029721 | A1 * | 5/2000 | H02K 7/1823 |
| WO | WO2014 077691 | A1 | 5/2014 | |
| WO | WO2017 010671 | A1 | 1/2017 | |

OTHER PUBLICATIONS

The part ISR of PCT/CN2018/088142.
The EESR of EPO application No. 18817701.8.
Notice of Allowance of the parallel RU application.
The International Search Report of corresponding International application No. PCT/CN2018/088142, dated Jul. 27, 2018.
The Notice of Allowance of parallel JP application No. 2020-519168.

* cited by examiner

PNEUMATIC ENGINE

CROSS-REFERENCE TO RELATED APPLICATIONS

This application is a continuation of International Application No. PCT/CN2018/088142 filed on May 24, 2018, which claims priority to Chinese Patent Application No. 201710458557.3, filed on Jun. 16, 2017. The disclosures of the aforementioned applications are hereby incorporated by reference in their entireties.

TECHNICAL FIELD

The present disclosure relates to an engine and, in particular, to a pneumatic engine.

BACKGROUND

Air pollution has become a worldwide environmental concern, and car exhaust emission is directly responsible for air pollution in major cities around the world. Therefore, everyone is constantly exploring new energy cars. Humans always have endless fantastic ideas: electricity, hydrogen, solar, wind, nuclear, biomass, gas, etc., of which the most striking is an air-powered vehicle.

The air-powered vehicle relies on a pneumatic engine to convert pressure energy into mechanical energy so that the vehicle is driven to go forward. Early pneumatic engines all used a steam engine-like structure, which were bulky and inefficient and could not meet actual usage requirements. The current research directs at developing a compact, efficient and reliable small pneumatic engine. At present, countries around the world, such as the United States, the United Kingdom and France are conducting research on pneumatic engines and gas-powered vehicles in addition to China. Most of them are in experiment, that is, trial productions, and there is no large-scale commercial application.

Under auspices from the U.S. Department of Energy, the University of Washington in the United States developed a prototype liquid nitrogen-powered aerodynamic vehicle in 1997. The air engine used is an improvement to an old five-cylinder in-line piston engine. Moreover, under support from the State Cash Technology Project Fund, the University of North Texas in the United States also conducted research on liquid nitrogen-powered cars, where high-pressure nitrogen obtained by liquid nitrogen passing through a heat exchanger is used to supply a pneumatic vane motor for operations, and is converted into mechanical work so that the car is driven to go forward. Under a circumstance when a fluid reservoir is loaded with 48 gallons (about 182 L) of liquid nitrogen, the car is travelling 15 km at 20 kmph, which is inefficient.

Professor C. J. Marquand of the University of Westminster in London of the United Kingdom designed a test-type two-stage eccentric vane air-powered engine with a weight of 50 KG and a working pressure of 4.5 MPa. An eccentric vane rotor is used with 12 vanes for each of the two stages. The air-powered engine uses a heat pipe heat exchange system. The high-pressure compressed air needs to be partially expanded in a long tube type aluminum heat exchanger to absorb the heat supplied by the ambient air before it enters the engine. Eventually, low efficiency is still the problem of this engine.

In 1991, French engineer Gury Negre obtained a patent for a compressed air-powered engine. The working principle is to use the high-pressure compressed air stored in the car to drive the piston in the engine cylinder to move so that the car is driven to go forward. This is the one closest to the air-powered vehicle in its true sense. Under the leadership of Gury Negre, MDI (a French company) was established to specialize on development of the air-powered car, of which the research results were applied to the air-powered vehicle AIRPOD from TATA Group of India. The car has a length of 2.13 meters and a weight of 275 kilograms. The maximum passenger capacity is 3 people, and the maximum speed is 70 kilometers. A gas tank loadable with 30 MPa compressed air is placed in the car, with a volume of 175 liters. The maximum driving range for a single fill-up is around 200 km.

Domestic research on the air-powered vehicle began late, and there were fewer trials in the product phase. China Central Television reported the air-powered vehicle of Xiangtian in May 2015. From the perspective of its working principle, power transmission of the air-powered bus of Xiangtian has gone through a series of flows, i.e. "compressed air-engine-generator-electromotor", which is more complicated than the air-powered vehicle of the European MDI (founded by French engineer Gury Negre). Therefore, there is more energy lost in the process. Hence, the air-powered vehicle crucially depends on efficiency of the air (gas) engine.

Most air engines are applied on the basis of the original piston engine or vane pump, for which energy conversion is achieved by the heating of the heat exchanger and output of power is achieved. Not only the structure is complicated, but also the efficiency is low, and thus it is difficult to meet requirements of endurance.

Chinese document CN201410167469.4 disclosed a variable-pressure jet-propulsion air engine, including an impeller chamber and an impeller, where injection holes for injecting compressed gas and exhaust holes for exhausting the compressed gas are provided on the impeller chamber, the impeller is installed in the impeller chamber via a rotation shaft, the impeller includes impeller teeth which are equally arranged along a rotational circumferential surface, the rotational circumferential surface of the impeller is in air gap fit with an inner surface of the impeller chamber, variable-pressure jet-propulsion grooves are further arranged in the inner surface of the impeller chamber, the distance between a variable-pressure jet-propulsion groove and an adjacent injection hole in the rotating direction of the impeller is larger than a tooth spacing, and when a tooth end of a certain impeller tooth rotates to the position of the variable-pressure jet-propulsion groove, two working chambers in front and rear of the impeller tooth are in communication with each other via the variable-pressure j et-propulsion groove. Through arrangement of the variable-pressure jet-propulsion grooves, gas injected from the injection holes can do work again before the gas is exhausted from the exhaust holes. This document is intended to improve energy efficiency and power of the engine, but the structure is similar to the vane pump and has low efficiency. At the same time, arrangement of the variable-pressure jet-propulsion grooves causes the air engine to rotate at a low rotating speed or even unable to rotate.

SUMMARY

In view of deficiencies of the prior art, the present disclosure provides a pneumatic engine in which compressed gas drives drive grooves of a rotating outer ring via a direct drive power core so that a propulsive force is generated to propel the rotating outer ring to achieve output of power, which has advantages such as a simple structure, high transmission efficiency, and strong endurance, and is also energy-saving and environmental-friendly.

In order to achieve the above objectives, the present disclosure is implemented by the following technical solutions:

A pneumatic engine, including: a rotating outer ring, an intermediate shaft and a direct drive power core, where the rotating outer ring and the direct drive power core are coaxially provided on the intermediate shaft, the rotating outer ring is rotatable relative to the intermediate shaft and the direct drive power core, the intermediate shaft is provided with a master air inlet and a master air outlet, the direct drive power core is provided with an inlet runner and an outlet runner, multiple drive grooves are provided on an inner ring surface of the rotating outer ring, compressed gas enters from the master air inlet of the intermediate shaft and is ejected via the inlet runner of the direct drive power core to act on a drive surface of the outer ring so that a propulsive force is generated to propel the rotating outer ring, and finally the compressed gas returns back to the master air outlet via the outlet runner of the direct drive power core to achieve continuous output of speed and torque.

Further, the rotating outer ring is fitted to the intermediate shaft via a side plate and a closed space is formed in which the direct drive power core can be provided in a staged manner to form a multi-stage power output device.

Further, the inlet runner of the direct drive power core travels in a spiral line extending outward from the center.

Further, the inlet runner of the direct drive power core travels in a logarithmic spiral line extending outward from the center, and the logarithmic spiral line has its pole provided on the axis line of the intermediate shaft and has a travelling angle of 2-15°.

Further, one or more inlet runners and outlet runners corresponding thereto are provided on the direct drive power core.

Further, two or more drive grooves are provided on the inner ring surface of the rotating outer ring, each of the drive grooves has a contour bottom surface and a drive surface, and a contour line of the contour bottom surface is a logarithmic spiral line with its pole provided on the axis line of the intermediate shaft.

Further, the intermediate shaft has at least one master air inlet and one master air outlet, and has at least one staged air inlet and one staged air outlet.

Further, the staged air inlet is in communication with the inlet runner of the direct drive power core, and the staged air outlet is in communication with the outlet runner of the direct drive power core.

A pneumatic engine assembly, including the pneumatic engine described above.

The pneumatic engine according to the present disclosure has a simple structure, high transmission efficiency and strong endurance. It can be widely used in vehicles, power generation equipment, and other fields that require power output devices.

BRIEF DESCRIPTION OF DRAWING(S)

DESCRIPTION OF EMBODIMENTS

The present disclosure will be further described below in conjunction with the accompanying drawings:

Embodiment 1

Figure 1:
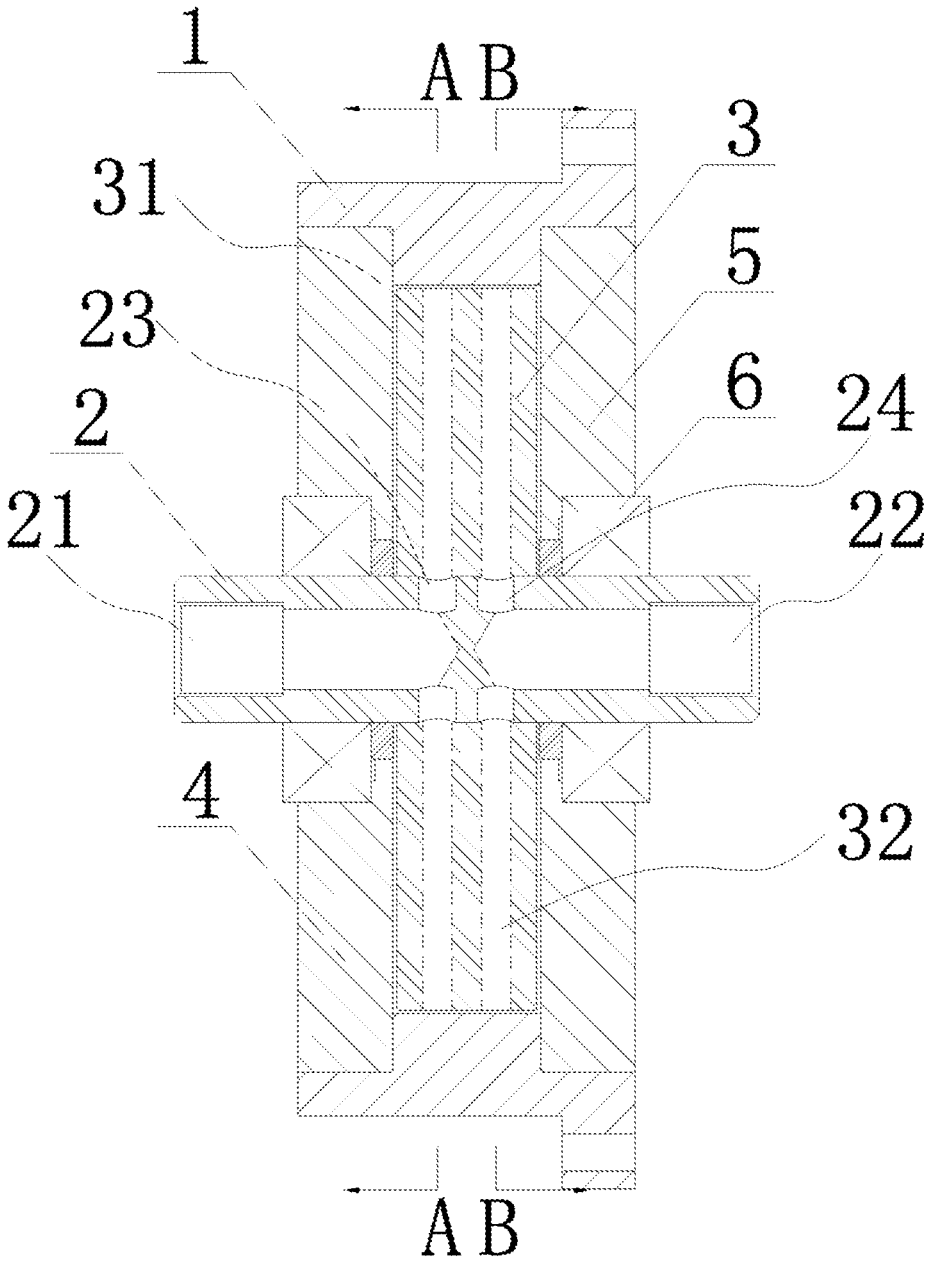
FIG. 1 is a structural view of a pneumatic engine according to the present disclosure.
Figure 2:
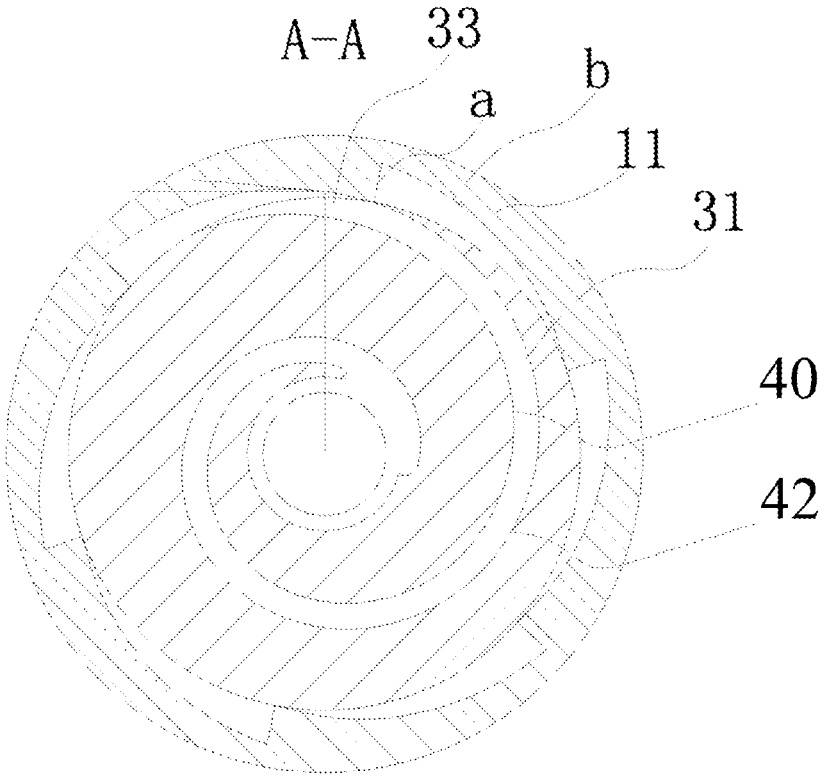
FIG. 2 is a section view of a direct drive power core along A-A according to the present disclosure.
Figure 3:
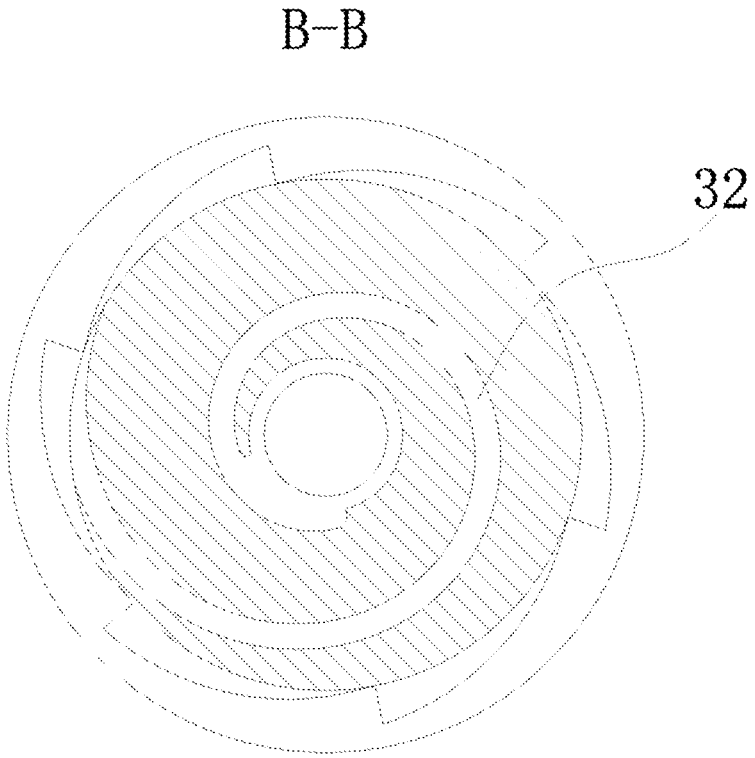
FIG. 3 is a section view of a direct drive power core along B-B according to the present disclosure.

As shown in FIG. 1-FIG. 3, provided is a pneumatic engine, including: a rotating outer ring 1, an intermediate shaft 2 and a direct drive power core 3, where the rotating outer ring 1 and the direct drive power core 3 are coaxially provided on the intermediate shaft 2, the rotating outer ring 1 is rotatable relative to the intermediate shaft 2 and the direct drive power core 3, and the intermediate shaft 2 and the direct drive power core 3 are fixed to stay still. The intermediate shaft 2 is provided with a master air inlet 21 and a master air outlet 22, the direct drive power core 3 is provided with an inlet runner 31 and an outlet runner 32, multiple drive grooves 11 are provided on an inner ring surface of the rotating outer ring 1, compressed gas enters from the master air inlet 21 of the intermediate shaft and is ejected via the spiral inlet runner 31 of the direct drive power core 3 to act on a drive surface a of the rotating outer ring 1 so that a propulsive force is generated to propel the rotating outer ring 1, and finally the compressed gas returns back to the master air outlet 22 via the outlet runner 32 of the direct drive power core 3 to achieve continuous output of speed and torque.

The rotating outer ring 1 is fitted to the intermediate shaft 2 via left and right baffles 4 and 5, wherein the left and right support baffles are side plates through which the rotating outer ring 1 according to the present disclosure is fitted, and a closed space is formed in which the direct drive power core 3 can be provided in a staged manner to form a multi-stage power output device.

The inlet runner 31 of the direct drive power core 3 has a first inner surface 40 and a second inner surface 42. The first inner surface 40 travels in a logarithmic spiral line extending outward from the center, and the logarithmic spiral line has its pole provided on the intermediate axis line of the intermediate shaft 2, due to a characteristic that the logarithmic spiral line has a constant pressure angle, compressed gas is minimized in loss during an injection process, and it can be ensured that the compressed gas is applied on the drive grooves 11 with the same time and propulsive force so that the transmission is stable. The traveling angle of the logarithmic spiral line determines the angle at which the compressed gas is ejected, and the magnitude of which affects the drive speed and the torque of the rotation of the rotating outer ring 1. If the traveling angle is too large, for the driving force, component force of the rotating outer ring 1 becomes smaller in a tangential direction, and even a phenomenon that there is no rotation occurs; if the traveling angle is too small, the drive surface a of the outer ring has a small force receiving area, and the driving force for the rotation is also small. Therefore, the logarithmic spiral line preferably has a traveling angle of 2-15°. Meanwhile the traveling angle of the logarithmic spiral line also determines the number of the drive grooves 11 on which ejection orifices 33 of the direct drive power core 3 acts simultaneously. One ejection orifice may drive two drive grooves at the same time, or possibly three, the design can be made as required.

Two or more drive grooves 11 are provided on the inner ring surface of the rotating outer ring 1, each of the drive grooves 11 has a contour bottom surface b and a drive surface a, and a third contour line of the contour bottom surface b is a logarithmic spiral line with its pole provided on the axis line of the intermediate shaft 2. When a radially outer end of the first inner surface 40 is rotationally aligned with a radially inner end of the contour bottom surface b, the third contour line of the contour bottom surface b is an extension line of the first inner surface 40 of the inlet runner 31 of the direct drive power core 3 which travels in a logarithmic spiral line. It is ensured that the drive grooves 11 of the rotating outer ring are subject to the same force and the direction of the force points to the drive surface a, and it is ensured that the rotating outer ring 1 is smoothly and stably rotated.

The direct drive power core 3 is provided with one or more inlet runners and outlet runners corresponding thereto, which may be two, three, four or more inlet runners, to match the number of drive grooves 11 provided on the inner ring surface of the rotating outer ring 1, where the outlet runners are provided corresponding to the inlet runners. A high rotating speed and torque as well as continuous and smoothly stable output can be obtained with a main consideration of continuity and smoothness of the rotating outer ring 1 driven to be rotated by the compressed gas and a match with parameters such as the rotational speed, etc.

The master air inlet on the intermediate shaft includes at least one master air inlet and at least one staged air inlet (23). The air outlet on the intermediate shaft includes one master air outlet and at least one staged air outlet (24).

The intermediate shaft has at least one master air inlet and one master air outlet, and meanwhile has at least one staged air inlet (23) and one staged air outlet (24). The staged air inlet (23) is in communication with the inlet runner of the direct drive power core, and the staged air outlet (24) is in communication with the outlet runner of the direct drive power core. The compressed gas from the pneumatic engine enters the staged air inlet (23) via the master air inlet of the intermediate shaft 2, and drives the rotating outer ring via the inlet runner, which then enters the staged air inlet (23) with a small pressure, and is finally exhausted via the master air outlet of the intermediate shaft 2.

Provided is a pneumatic engine assembly including the pneumatic engine described above.

Embodiment 2

Figure 4:
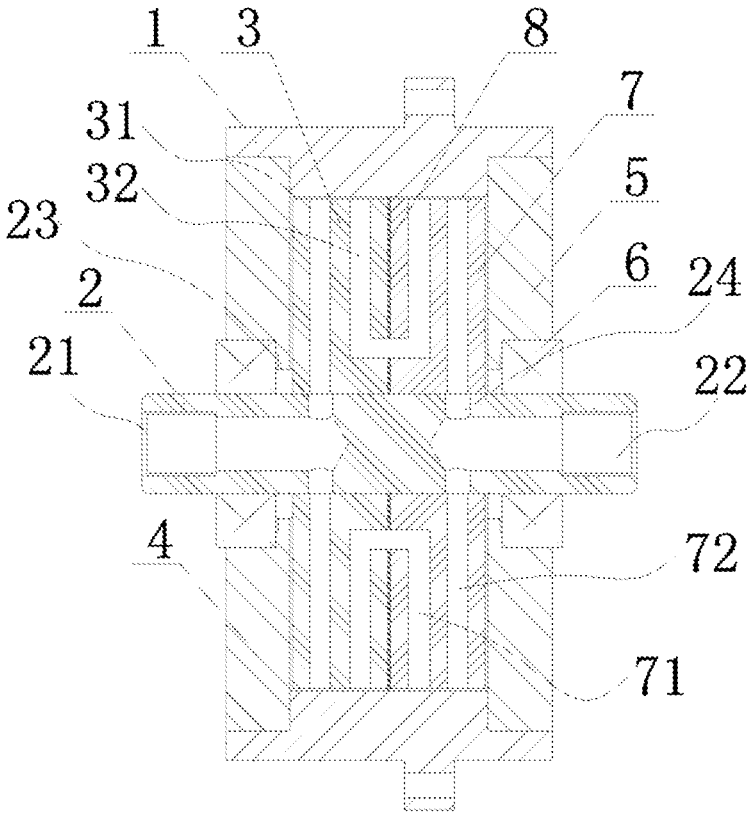
FIG. 4 is a schematic view of a multi-stage direct drive power core according to the present disclosure.

As shown in FIG. 2-FIG. 4, provided is a pneumatic engine, including: a rotating outer ring 1, an intermediate shaft 2, a first-stage direct drive power core 3, a second-stage direct drive power core 7, and left and right support baffles 4 and 5, where the rotating outer ring 1, the first-stage direct drive power core 3, the second-stage direct drive power core 7 and the left and right support baffles 4 and 5 are coaxially provided on the intermediate shaft 2, the left and right support baffles are side plates through which the rotating outer ring of the present disclosure is fitted, the rotating outer ring 1 is integrally connected to the left and right support baffles 4 and 5 to engage with the intermediate shaft 2 via a bearing 6, a two-stage closed space is formed through a separation by a separator 8, the intermediate shaft 2 is provided with a master air inlet 21 and a master air outlet 22, the first-stage direct drive power core 3 and the second-stage direct drive power core 7 are provided with inlet runners 31 and 71 and outlet runners 32 and 72, multiple drive grooves 11 are provided on an inner ring surface of the rotating outer ring 1, and compressed gas enters from the master air inlet 21 of the intermediate shaft 2 and then flow into the inlet runner 31 of the first-stage direct drive power core 3 through the first-stage air inlet. The gas acts on a drive surface a of the outer ring, and then enters the inlet runner 71 of the second-stage direct drive power core 7 via the outlet runner 32 of the first-stage direct drive power core 3, at this point, the air pressure is reduced to 95%, and acts on the drive groove 11 of the outer ring again so that a propulsive force is generated to propel the rotating outer ring 1, and finally the compressed gas returns back to the master air outlet 22 via the outlet runner 72 of the direct drive power core 7 to achieve continuous output of speed and torque.

According to load requirements, the engine can be designed. The direct drive power core 3 may be set in two stages, or three stages, or multiple stages. The air pressure is reduced by 5% by doing work per stage, that is, for previous stage, 95% of pressure enters the next stage to do work, making full use of energy and improving the efficiency of use at best to meet requirements on output of torque and rotating speed.

Figure 5:
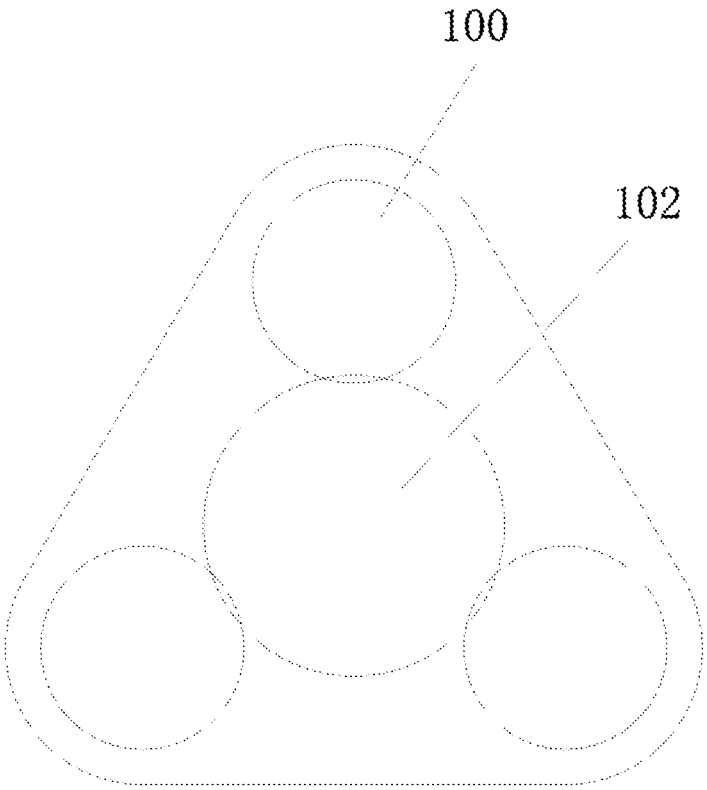
FIG. 5 is a schematic view of an engine assembly.

As shown in FIG. 5, for a pneumatic engine assembly, a flywheel 102 may be driven by one or more pneumatic engines 100 to match adjustments of inlet pressure and flow rate so that changes in output torque and speed are achieved and various road conditions are satisfied.

Embodiment 3

A prototype that matches Audi 2.5LV6 is designed:

1. Main parameters are as follows:

a) Gas source: 200 L of liquid nitrogen;

b) Diameter Φ of a drive groove of the pneumatic engine: 108 mm; diameter Φ of a gear of a rotating outer ring: 136 mm;

c) The number of pneumatic engines: 3 d) Section size of the drive groove of the rotating outer ring: 20 mm×8 mm (length× height) for a first stage, 20 mm×8 mm (length×height) for a second stage, 16 mm×8 mm (length×height) for a third stage, and 12 mm×8 mm (length×height) for a fourth stage;

e) Flywheel diameter Φ: 244.8 mm;

f) Weight of a single pneumatic engine: 9 kg; where weight of the rotating outer ring: 8 kg;

g) Flywheel weight: 20 kg;

h) Weight of a pneumatic engine assembly: 70 Kg (including accessories such as 3 pneumatic engines, flywheels and bases, etc.)

2. Torque (1) Two drive grooves of the pneumatic engine are subject to force (when pressure is 0.6 MPa, the speed is 3000 r/min)

Gas impulsive torque of a single pneumatic engine at the first stage $N_{gas\ 1}$=10.4 N·m;

Gas impulsive torque of a single pneumatic engine at the second stage $N_{gas\ 2}$=9.8 N·m;

Gas impulsive torque of a single pneumatic engine at the third stage $N_{gas\ 3}$=7.5 N·m;

Gas impulsive torque of a single pneumatic engine at the fourth stage $N_{gas\ 4}$=5.3 N·m;

Moment of inertia of an outer ring of a single pneumatic engine $N_{inertia}$=11.7 N·m;

Torque of a single pneumatic engine N=33+11.7=44.7 N·m.

(2) Flywheel (speed n of the flywheel=1666 r/min)

Torque at which the flywheel is driven by the pneumatic engine $N_{flywheel}$=44.7*1.8*3=241.3 N·m;

Moment of inertia of the flywheel $N_{inertia}$=18.2 N·m;

(3) Total torque output by the engine assembly

Total torque output by the engine $N_{output}$=241.3+18.2=259.5 N·m; its torque matches Audi A6 L2.5V6 engine 250 N·m.

In the present embodiment, 200 L of liquid nitrogen is used as the gas source, and an expansion coefficient at which the liquid nitrogen is gasified is 800 (0° C., one atmospheric pressure) which is equivalent to 4 bottles of compressed nitrogen at a pressure of 20 Mpa and a volume of 200 L, that is, 34 bottles of prototype gas source at a pressure of 12 Mpa and a volume of 40 L. When the gas source is operated at 0.6 MPa, it can be used continuously for about 408 minutes, that is, 6.8 hours. Calculated at a speed of 80 KM/h, the traveling distance can reach about 544 KM, and the equivalent traveling distance is much larger than that in the current research. The price of liquid nitrogen is RMB 1 yuan/kg. A fill-up of 200 L accounts for about 160 Kg, and the price is about RMB 160 yuan, equivalent to about RMB 0.3 yuan per kilometer. If liquid air is used as the gas source, the cost can be further reduced.

The pneumatic engine according to the present disclosure completely changes an application method in which an improvement is made on the basis of the original piston engine or the vane pump, and principles of a novel engine are invented. It not only has a simple structure, but also has advantages such as high efficiency and strong endurance. etc. It is environmental-friendly, which can lessen the greenhouse effect and reduce PM2.5; meanwhile there are also many auxiliary applications, plus significant economic and social benefits. It can be widely used in vehicles such as cars, motorcycles and bicycles, power generation equipment, and other fields that require power output devices.

The above disclosures are merely embodiments where technical contents of the present disclosure are used. Any modifications and variations made by those skilled in the art using the present disclosure shall fall into the scope of the claims of the present disclosure, but not limited to those disclosed in the embodiments.

What is claimed is:

1. A pneumatic engine, comprising: a rotating outer ring, an intermediate shaft having an axis line, and a direct drive power core, wherein the rotating outer ring and the direct drive power core are coaxially provided on the intermediate shaft, the rotating outer ring is rotatable relative to the intermediate shaft and the direct drive power core, the intermediate shaft is provided with a master air inlet and a master air outlet, the direct drive power core is provided with an inlet runner and an outlet runner, and multiple drive grooves are provided on an inner ring surface of the rotating outer ring, wherein compressed gas enters from the master air inlet of the intermediate shaft and is ejected via the inlet runner of the direct drive power core to act on a drive surface of the outer ring so that a propulsive force is generated to propel the rotating outer ring and then the compressed gas proceeds to the master air outlet via the outlet runner of the direct drive power core to achieve continuous output of speed and torque;

wherein a first inner surface of the inlet runner of the direct drive power core has a first contour line extending outward from a center on the axis line, a second inner surface of the inlet runner of the direct drive power core has a second contour line extending outward, and part of the first contour line is a logarithmic spiral having a pole at the center and part of the second contour line is a spiral;

wherein each of the drive grooves comprises:

a contour bottom surface and a drive surface, wherein a third contour line of the contour bottom surface is a sector of a logarithmic spiral such that, when a radially inner end of the contour bottom surface is aligned with a radially outer end of the first inner surface, the third contour line is an extension of the logarithmic spiral of the first contour line.

2. The pneumatic engine according to claim 1, wherein the rotating outer ring is fitted to the intermediate shaft via a side plate and a closed space is formed in which the direct drive power core is provided.

3. The pneumatic engine according to claim 1, wherein the direct drive power core is provided with two or more of the inlet runner and two or more of the outlet runner.

4. The pneumatic engine according to claim 1, wherein the intermediate shaft has at least one staged air inlet and at least one staged air outlet.

5. The pneumatic engine according to claim 4, wherein the at least one staged air inlet is in communication with the inlet runner of the direct drive power core, and the at least one staged air outlet is in communication with the outlet runner of the direct drive power core.

* * * * *